United States Patent [19]

Poff et al.

[11] 4,441,957

[45] Apr. 10, 1984

[54] METHOD FOR SELECTIVELY ETCHING INTEGRAL CATHODE SUBSTRATE AND SUPPORT

[75] Inventors: Wayne R. Poff, Lancaster; Donald W. Bartch, Wrightsville, both of Pa.

[73] Assignee: RCA Corporation, New York, N.Y.

[21] Appl. No.: 210,246

[22] Filed: Nov. 25, 1980

[51] Int. Cl.[3] ..... C23F 1/02; H01L 21/312

[52] U.S. Cl. ..... 156/656; 156/659.1; 156/660

[58] Field of Search ..... 156/659.1, 660, 637, 156/655, 656, 664

[56] References Cited

U.S. PATENT DOCUMENTS 3,432,900 3/1969 Kerstetter ..... 156/656

4,155,801 5/1979 Provancher ..... 156/660

FOREIGN PATENT DOCUMENTS 23451 of 1905 United Kingdom ..... 156/659.1

OTHER PUBLICATIONS

RCA Technical Notes TN No. 1159, 7/1976, (Turnbull).

*Primary Examiner*—Bruce H. Hess

*Attorney, Agent, or Firm*—E. M. Whitacre; D. H. Irlbeck; L. Greenspan

[57] ABSTRACT

In a method for preparing an integral cathode substrate and support in which selected surface portions of a formed metal part are masked, the unmasked surface portions etched, and then the mask removed, the improvement wherein the masking step is conducted by pressing surface portions of an etch-resistant, compressible sheet against the selected surface portions of the part.

9 Claims, 5 Drawing Figures

METHOD FOR SELECTIVELY ETCHING INTEGRAL CATHODE SUBSTRATE AND SUPPORT

BACKGROUND OF THE INVENTION

This invention relates to a novel method for selectively etching an integral or unitary cathode substrate and support; and particularly, although not exclusively, to selectively etching a cylindrical one-piece bimetal cathode substrate and support sleeve.

A one-piece bimetal cathode substrate and support sleeve is disclosed in RCA Technical Notes TN No. 1159 mailed July 23, 1976. That one-piece part is described generally as a cup-shaped nickel-alloy cathode substrate integrally supported on a thin cylinder and endwall of a structural alloy such as a nickel-chromium alloy. The part is fabricated from a bimetal laminate comprised of layers of the two alloys which are clad or otherwise joined together. That one-piece part has been fabricated by the general method disclosed in U.S. Pat. No. 3,432,900 issued March 18, 1969 to D. R. Kerstetter. By this method, a cup-and-sleeve is deep drawn from a bimetal laminate strip. Then, selected portions of the nickel-alloy layer are removed by etching. The etching is achieved by selectively masking the surface of the nickel-alloy layer with an etch-resistant material and then etching away the unmasked portions with a liquid etchant. The etch-resistant material is applied by painting or spraying or by some photographic technique and then later removed. This prior method is generally labor intensive and costly.

SUMMARY OF THE INVENTION

In the novel method, the metal part is selectively masked during etching by temporarily pressing surface portions of an etch-resistant, compressible sheet, such as a silicone rubber sheet, against selected surface portions of the part. By the novel method, the surface of the part is not coated thereby avoiding much of the cost of applying and of removing the coating. The sheet is more easily applied and removed than is a coating, and the sheet may be reused instead of being destroyed after its initial use as is the case with a coating.

To assure good physical contact, the sheet is preferably urged towards the part with a substantially rigid backing plate. In a preferred form of the method, during the etching step, the endwall of a cylindrical part is pressed into the compressible sheet and, also, the sheet if squeezed between a pressure plate and a backing plate to provide sideward pressure of the sheet material against the cylindrical sidewall of the part.

DETAILED DESCRIPTION OF THE PREFERRED EMBODIMENTS

Figure 1:
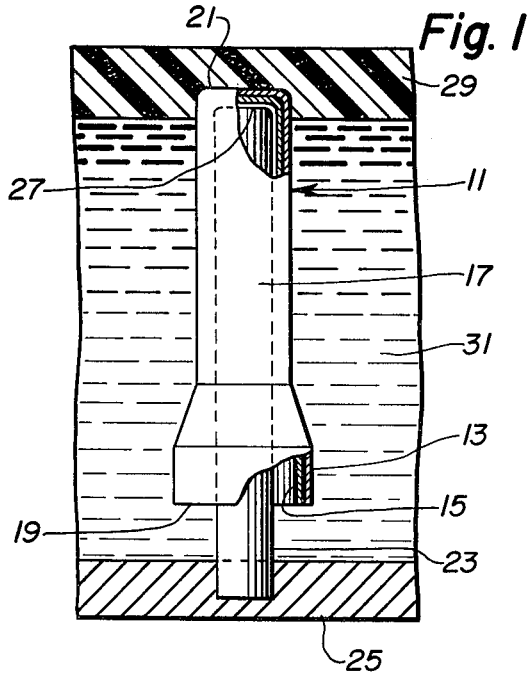
FIG. 1 is a fragmentary partially-sectional elevational view of a formed bimetal part being etched by a first embodiment of the novel method.

FIG. 1 shows a typical formed bimetal part or blank 11 being etched according to a first embodiment of the novel method. The blank 11 is deep-drawn from a bimetal strip so as to provide a cup-shaped structure with a cathode-substrate nickel-alloy layer 13 on the outside and a structural nickel-chromium alloy layer 15 on the inside. A typical cathode-substrate alloy consists essentially of at least 99.0-weight-percent nickel and up to about 0.05-weight-percent silicon and magnesium. The part 11 is comprised of a cylindrical sleeve or sidewall 17 about 2.16 mm (85 mils) at its narrowest outside diameter and about 8.51 mm (335 mils) in overall height. The sleeve 17 is open at one end 19 and closed by an endwall 21 at the other end. The cathode-substrate alloy layer 13 is about 0.028 mm (1.1 mils) thick and the structural alloy layer 15 is about 0.048 mm (1.9 mils) thick. The cathode-substrate alloy layer 13 is much more soluble in certain etchants than the inner layer 15, particularly relatively dilute acids, and this differential is exploited in the novel method. In preferred forms of the novel method, the outer layer 13 is soluble and the inner layer 15 is substantially insoluble in the etchant.

By the first embodiment of the novel method, the formed cup-shaped part 11 is placed on an upstanding cylindrical mandrel 23 which is supported on a base plate 25. The inner surface of the endwall 21 is in contact with the upper end surface 27 of the mandrel 23. Preferably, the contacting surfaces should substantially mate with one another. A sheet 29 of compressible etch-resistant material is pressed against the outer surface of the endwall such that the sheet 29 is compressed and presses against the adjacent portions of the sidewall thereby masking selected areas of the part 11. The greater the pressure, the greater the amount of sidewall 17 that is covered by the sheet 29.

With the part 11 and the sheet 29 in this position, an etchant 31, which in this embodiment is a 32-weight-percent solution of nitric acid at a temperature of about 80° C., contacts with and dissolves the unmasked portions of the cathode-substrate layer 13. The etchant may also contact the structural alloy layer 15 but, since the structural alloy layer 15 is substantially insoluble in the etchant, substantially no dissolution takes place. As shown in FIG. 1, the etchant 31 floods the surfaces of the part 11 except where the surface is masked. This can be achieved by dipping the part in the etchant or by pumping the etchant through the space between the base plate 25 and the plastic sheet 29. Instead of flooding, the etchant can be sprayed on the unmasked surfaces of the part 11.

Figure 2:
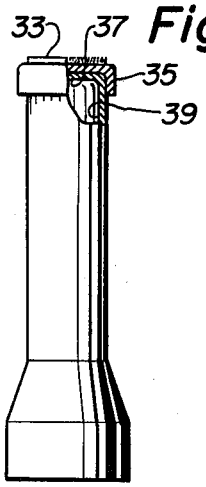
FIG. 2 is a partially broken-away elevational view of the etched bimetal part shown in FIG. 1 after the cathode coating has been applied to the cathode substrate thereof.

When the etching step is completed, the etchant 31 and the sheet 29 are removed. Then, the etched part 11 is removed from the mandrel 23, rinsed in deionized water to remove excess etchant and then dried at room temperature. Subsequently, a cathode coating is applied to the outer surface of the endwall 21 which was masked by the sheet 29. As shown in FIG. 2, a cathode coating 33 resides on a cap 35 of cathode-substrate nickel alloy, which is the unetched portion of the layer 13 of FIG. 1. This cap 35 is supported on the endwall 37 and sidewall 39 of the structural nickel-chromium alloy, which is substantially insoluble in the etchant used and is the unetched structural layer 15 of FIG. 1.

Figure 5:
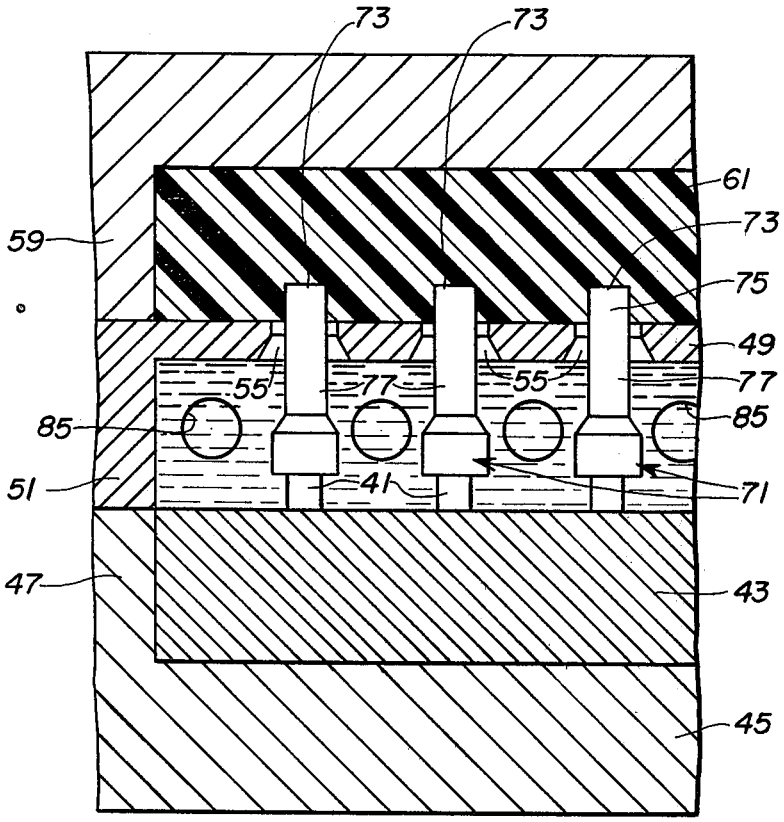
FIG. 5 is a fragmentary sectional elevational view of several parts being etched in the apparatus shown in FIGS. 3 and 4.
Figure 4:
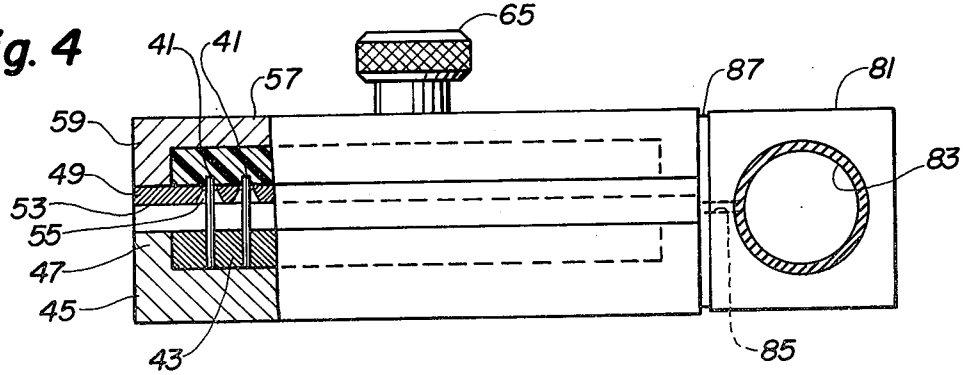
FIGS. 3 and 4 are partially-sectional front and side elevational views respectively of an apparatus for etching a batch of bimetal parts according to a second embodiment of the novel method.
Figure 3:
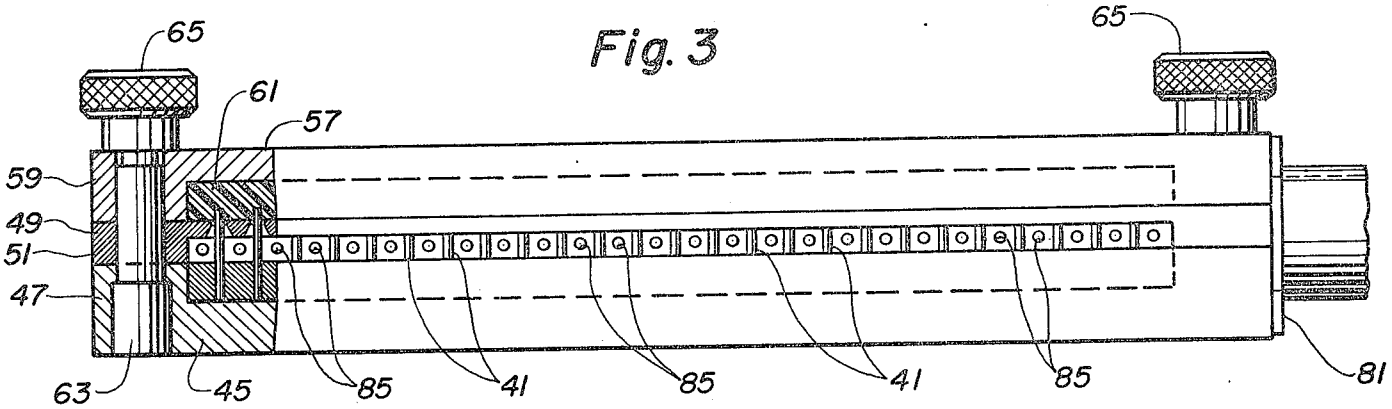

A second embodiment of the novel method may be practiced in the apparatus shown in FIGS. 3, 4 and 5. This apparatus comprises an orthogonal array of pins or mandrels 41 set in spaced relation in a pin holder 43. There are twenty-five mandrels 41 spaced apart on about 250-mil centers in one direction, as shown in FIG. 3, and twelve mandrels spaced apart on about 250-mil centers in the other direction, as shown in a FIG. 4.

The pin holder 43 resides in a base 45 having an integral upward-extending peripheral sidewall 47. An apertured pressure plate 49 rests on the sidewall 47 of the base 45. The pressure plate 49 has two downward-extending sidewalls 51 on opposite sides thereof as shown in FIG. 3 which support the pressure plate 49 on the sidewall 47 of the base 45. The other two sides of the pressure plate 49 are open as indicated by the numeral 53 in FIG. 4. There is a plurality of apertures 55 through the pressure plate 49 through which the pins 41 extend. Each aperture 55 is about 0.76 mm (30 mils) larger in diameter than the outside diameter of the part to be etched. Also each aperture 55 is countersunk on the side of the pressure plate 49 facing the pin holder 43.

A backing plate 57 having a downwardly-extending peripheral sidewall 59 covers the apparatus, with the sidewall 59 thereof resting on the periphery of the pressure plate 49. A compressible sheet 61 of silicone rubber resides in the space within the sidewall 59 of the backing plate 57. The compressible sheet 61 may be a solid rubber or plastic which is substantially insoluble and nonreactive with the etchant that is used in the novel method. The sheet 61 has a substantially-uniform thickness and is thicker than the height of the sidewall 59 of the backing plate 57 so that the sheet 61 is compressed when the backing plate 57 rests on the pressure plate 49. The pins 41 are of such length that they extend through the apertures 55 into the sheet 61 further compressing the sheet 61. Two locating bolts 63 and locking nuts 65 hold the above-described assembly together through registered apertures in each of the plates on opposite sides of the assembly.

Referring now to FIG. 5, to practice the second embodiment of the novel method, blanks or parts 71 are positioned over the pins 41 substantially as described in FIG. 1. The pin holder 43, next is positioned in the base 45. Then, the pressure plate 49 is positioned over the base 45 with the pins 41 and the parts 71 extending through the apertures 55. Now, a compressible sheet 61 of silicone rubber is positioned in the backing plate 57, and that combination is positioned on the pressure plate 49. The two locating bolts 63 are positioned in the registered apertures in each of the above-mentioned plates. Then, the locking nuts 65 are screwed down on the bolts 63 thereby urging the backing plate 57 towards the pressure plate 49. The compressible sheet 61 is squeezed against the endwall 73 of the part 71 and also against adjacent portions 75 of the sidewall 77 of the part 71, thereby masking selected surface portions of the part 71.

After the apparatus is assembled with the part 71 therein, a manifold 81 is coupled to one of the sides of the apparatus having an open portion 53 in the pressure plate 49 as shown in FIG. 4. The manifold 81 has one large feeder passage 83 and a plurality of connecting side passages 85 for pumping liquid etchant into and through the open positions 53 and around the parts 71. A gasket 87 helps to seal the space between the apparatus and the manifold 81. The etchant is pumped from right to left in FIG. 4. The etchant drains out of the apparatus into a sump (not shown) from which it is recirculated back to the manifold 81 until the etching step is completed.

In a preferred form of the second embodiment of the novel method, the etching solution consists essentially of 45 weight parts of a 71-weight-percent solution of nitric acid, 10 weight parts of an 85-weight-percent phosphoric acid solution and 45 weight parts of deionized water. The etching solution is maintained at a temperature of about 80° C.±5° C. throughout the etching step. The etching step is conducted for about 5 minutes at this temperature. Complete etching leaves a dull metallic finish on the etched portion. Incomplete etching can be recognized by the presence of shiny areas where the dull metallic finish should appear. After the etching step is completed, deionized water at 60° C.±5° C. is run through the apparatus for about 5 minutes. Then, after the apparatus is disassembled, the etched parts are removed from the pins and placed in an overflow rinse container, where the cathode substrates are rinsed in deionized water at a temperature of about 60° C.±5° C. flowing at a rate of about 3 gallons per minute for about 5 minutes.

The compressible silicone rubber sheet 61 can be replaced with a sheet of another compressible solid material that is resistant to chemical attack by the etchant. The preferred material is a room-temperature vulcanizing (RTV) silicone rubber. A compressible silicone rubber sheet may be prepared by casting a mixture of about 54-weight-percent liquid silicone elastomer (such as Sylgard 186 marketed by Dow-Corning, Midland, Mich.), 6% catalyst for the elastomer, and 40% liquid viscosity reducer (such as Silicone Rubber Diluent 910 marketed by General Electric Co., Waterford, N.Y.). The casting is permitted to cure overnight at about room temperature. Decreasing the content of viscosity reducer makes the silicone rubber product stiffer and less compressible, while increasing the content of viscosity reducer makes the product softer and more compressible.

Preferably, the compressible sheet 61 has a substantially-uniform thickness. In one embodiment, the sheet 61 was prepared with recesses adapted to receive the closed end of the part. In that embodiment, the edge of the etched area was not as sharply defined as with a sheet without such recesses. Also, on disassembling the apparatus after etching, the etched parts tended to stay with the sheet and required more labor to removed than with a sheet without recesses.

We claim:

1. In a method for preparing an integral cathode substrate and support including (a) providing a formed metallic part, said part including a cathode substrate and an integral support therefore, (b) masking selected portions of the surface of said part with an etch-resistant mask, (c) etching the unmasked portions of said surface to a desired depth (d) and then removing said mask, the improvement wherein said masking step is conducted by providing a chamber around said part and pressing surface portions of an etch-resistant, compressible sheet against said selected surface portions of said part, said sheet constituting one wall of said chamber, and wherein said etching step is conducted by passing a liquid etchant through said chamber into contact with said unmasked surface portions of said part.

2. The method defined in claim 1 wherein said metallic part comprises a bimetal laminate of which one metal thereof is soluble in a particular etchant and the other metal thereof is substantially insoluble in said etchant.

3. The method defined in claim 2 wherein said metallic part comprises a substantially cylindrical bimetal sidewall and a bimetal endwall integral with one end of said sidewall, said endwall comprising said cathode substrate, and wherein said selected masked portions include said endwall and adjacent portions of said sidewall.

4. The method defined in claim 3 including mounting said metallic part on a mandrel having an end surface which mates with the internal surface of said bimetal endwall, positioning one side of said sheet on a substantially rigid backing plate, contacting the other surface of said sheet against the external surface of said bimetal endwall, and urging said backing plate towards said mandrel during said etching step.

5. The method defined in claim 4 wherein a substantially rigid pressure plate having an aperture therethrough contacts said other surface of said sheet and said part extends through said aperture in said pressure plate, and the additional step of urging said pressure plate towards said backing plate during said etching step.

6. The method defined in claim 1 wherein said compressible sheet is constituted of silicone rubber.

7. The method defined in claim 1 wherein said etching step is conducted by dipping the masked part in a liquid etchant.

8. The method defined in claim 1 wherein said etching step is conducted by pumping a liquid etchant into contact with said unmasked surface portions of said part.

9. The method defined in claim 1 including providing a plurality of said formed metal parts, each part including an endwall and a peripheral sidewall integral with said endwall, mounting each metal part on a mandrel with all of the external surfaces of said endwalls located in a plane, and pressing surface portions of said sheet against all of said endwalls in said plane.

* * * * *